US008605012B2

(12) United States Patent
Park et al.

(10) Patent No.: US 8,605,012 B2
(45) Date of Patent: Dec. 10, 2013

(54) METHOD OF DRIVING PLASMA DISPLAY APPARATUS

(75) Inventors: Kirack Park, Gumi (KR); Gyungrae Kim, Gumi (KR); Jongwoon Bae, Gumi (KR); Seonghwan Ryu, Gumi (KR)

(73) Assignee: LG Electronics Inc., Seoul (KR)

( * ) Notice: Subject to any disclaimer, the term of this patent is extended or adjusted under 35 U.S.C. 154(b) by 1141 days.

(21) Appl. No.: 12/244,552

(22) Filed: Oct. 2, 2008

(65) Prior Publication Data

US 2009/0091517 A1 Apr. 9, 2009

(30) Foreign Application Priority Data

Oct. 5, 2007 (KR) ..... 10-2007-0100640

(51) Int. Cl.
*G09G 3/18* (2006.01)

(52) U.S. Cl.
USPC ..... 345/60; 345/50; 345/68

(58) Field of Classification Search
USPC ..... 345/60
See application file for complete search history.

(56) References Cited

U.S. PATENT DOCUMENTS

2002/0135542 A1* 9/2002 Kim et al. ..... 345/50
2003/0169216 A1* 9/2003 Chung et al. ..... 345/60
2005/0225510 A1* 10/2005 Ito et al. ..... 345/60
2006/0214882 A1* 9/2006 Jung et al. ..... 345/60
2006/0279479 A1* 12/2006 Jung et al. ..... 345/60
2007/0229404 A1* 10/2007 Lee ..... 345/60
2009/0140954 A1* 6/2009 Kim et al. ..... 345/68

FOREIGN PATENT DOCUMENTS

KR 10-2004-0000327 A 1/2004
KR 10-2004-0003529 A 1/2004
KR 10-2006-0129919 A 12/2006

OTHER PUBLICATIONS

Korean Office Action dated Nov. 25, 2008.

* cited by examiner

*Primary Examiner* — Sumati Lefkowitz
*Assistant Examiner* — Jose Soto Lopez
(74) *Attorney, Agent, or Firm* — KED & Associates, LLP

(57) ABSTRACT

A method of driving a plasma display apparatus including a scan electrode and a sustain electrode, that are positioned parallel to each other, are disclosed. The method includes supplying a scan signal to the scan electrode during an address period of a first subfield among a plurality of subfields of a frame, supplying a reset signal to the scan electrode during a reset period of a second subfield immediately following the first subfield, supplying a first signal between the scan signal and the reset signal to the scan electrode, and supplying a second signal overlapping the first signal to the sustain electrode. A pulse width of the second signal is smaller than a pulse width of the first signal.

19 Claims, 16 Drawing Sheets

(a)

(b)

METHOD OF DRIVING PLASMA DISPLAY APPARATUS

This application claims the benefit of Korean Patent Application No. 10-2007-0100640 filed on Oct. 5, 2007, which is hereby incorporated by reference.

BACKGROUND

1. Field

Exemplary embodiments relate to a method of driving a plasma display apparatus.

2. Description of the Background Art

A plasma display apparatus includes a plasma display panel.

The plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY

In one aspect, a method of driving a plasma display apparatus including a scan electrode and a sustain electrode that are positioned parallel to each other, the method comprises supplying a scan signal to the scan electrode during an address period of a first subfield among a plurality of subfields of a frame, supplying a reset signal to the scan electrode during a reset period of a second subfield immediately following the first subfield, supplying a first signal between the scan signal and the reset signal to the scan electrode, and supplying a second signal overlapping the first signal to the sustain electrode, a pulse width of the second signal being smaller than a pulse width of the first signal.

In another aspect, a method of driving a plasma display apparatus including a scan electrode and a sustain electrode that are positioned parallel to each other, the method comprises supplying a first reset signal to the scan electrode during a reset period of a first subfield among a plurality of subfields of a frame, supplying a scan signal to the scan electrode during an address period following the reset period of the first subfield, supplying a second reset signal, whose a maximum voltage is lower than a maximum voltage of the first reset signal, to the scan electrode during a reset period of a second subfield immediately following the first subfield, supplying a first signal between the scan signal and the second reset signal to the scan electrode, and supplying a second signal overlapping the first signal to the sustain electrode, a pulse width of the second signal being smaller than a pulse width of the first signal.

In still another aspect, a method of driving a plasma display apparatus including a scan electrode and a sustain electrode that are positioned parallel to each other, the method comprises supplying a scan signal to the scan electrode during an address period of a first subfield among a plurality of subfields of a frame, supplying a reset signal to the scan electrode during a reset period of a second subfield immediately following the first subfield, supplying a first signal between the scan signal and the reset signal to the scan electrode, and supplying a second signal overlapping the first signal to the sustain electrode to generate an erase discharge between the scan electrode and the sustain electrode, a pulse width of the second signal being smaller than a pulse width of the first signal.

BRIEF DESCRIPTION OF THE DRAWING

The accompany drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Reference will now be made in detail embodiments of the invention examples of which are illustrated in the accompanying drawings.

Figure 1:
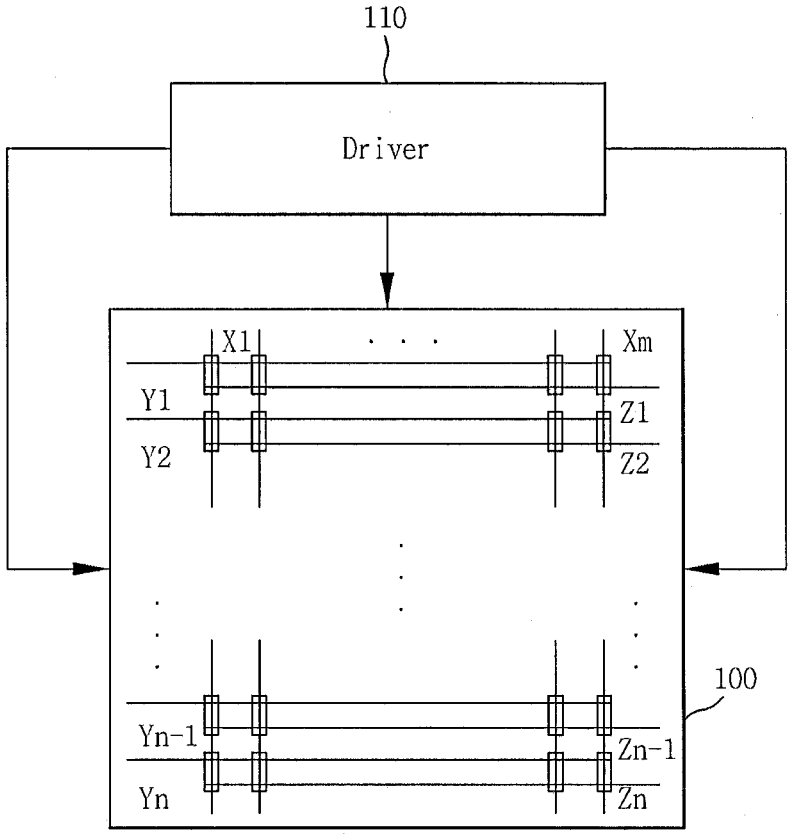
FIG. 1 illustrates a configuration of a plasma display apparatus according to an exemplary embodiment.

FIG. 1 illustrates a configuration of a plasma display apparatus according to an exemplary embodiment.

As shown in FIG. 1, the plasma display apparatus according to the exemplary embodiment includes a plasma display panel 100 and a driver 110.

The plasma display panel 100 includes scan electrodes Y1 to Yn and sustain electrodes Z1 to Zn positioned parallel to each other, and address electrodes X1 to Xm positioned to intersect the scan electrodes Y1 to Yn and the sustain electrodes Z1 to Zn.

The driver 110 supplies driving signals to at least one of the scan electrodes Y1 to Yn, the sustain electrodes Z1 to Zn, or the address electrodes X1 to Xm to thereby display an image on the screen of the plasma display panel 100.

Although FIG. 1 has shown a case where the driver 110 is formed in the form of a signal board, the driver 110 may be formed in the form of a plurality of boards depending on the electrodes on the plasma display panel 100. For example, the driver 110 may include a first driver (not shown) for driving the scan electrodes Y1 to Yn, a second driver (not shown) for driving the sustain electrodes Z1 to Zn, and a third driver (not shown) for driving the address electrodes X1 to Xm.

Figure 2:
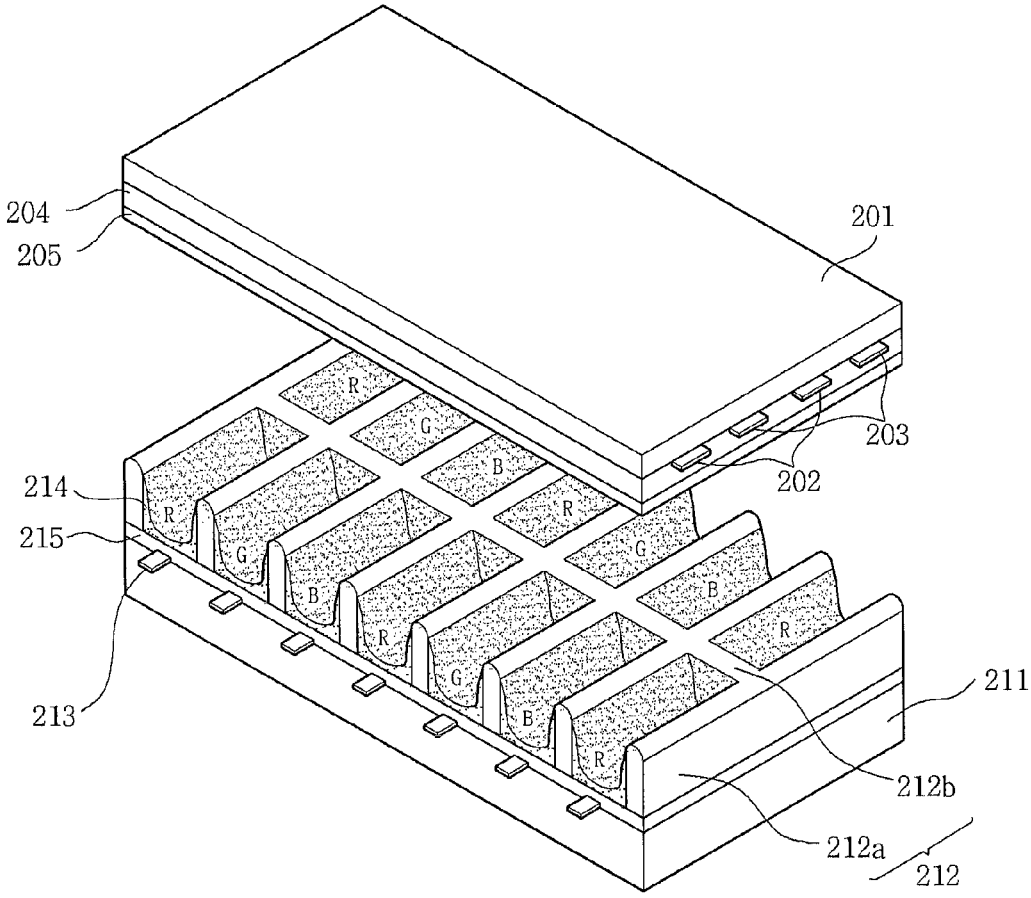
FIG. 2 illustrates a structure of a plasma display panel.

FIG. 2 illustrates a structure of the plasma display panel.

As shown in FIG. 2, the plasma display panel may include a front substrate 201, on which a scan electrode 202 and a sustain electrode 203 are positioned parallel to each other, and a rear substrate 211 on which an address electrode 213 is positioned to intersect the scan electrode 202 and the sustain electrode 203.

An upper dielectric layer 204 may be positioned on the front substrate 201, on which the scan electrode 202 and the sustain electrode 203 are positioned, to limit a discharge current of the scan electrode 202 and the sustain electrode 203 and to provide electrical insulation between the scan electrode 202 and the sustain electrode 203.

A protective layer 205 may be positioned on the front substrate 201, on which the upper dielectric layer 204 is positioned, to facilitate discharge conditions. The protective layer 205 may be formed of a material having a high secondary electron emission coefficient, for example, magnesium oxide (MgO).

A lower dielectric layer 215 may be positioned on the rear substrate 211, on which the address electrode 213 is positioned, to cover the address electrode 213 and to provide electrical insulation of the address electrodes 213.

Barrier ribs 212 of a stripe type, a well type, a delta type, a honeycomb type, and the like, may be positioned on the lower dielectric layer 215 to partition discharge spaces, i.e., discharge cells. Hence, a red discharge cell R, a green discharge cell G, and a blue discharge cell B, and the like, may be positioned between the front substrate 201 and the rear substrate 211.

Widths of the red, green, and blue discharge cells R, G, and B may be substantially equal to one another. However, a width of at least one of the red, green, and blue discharge cells R, G, and B may be different from widths of the other discharge cells.

The barrier rib 212 may have various forms of structures as well as a structure shown in FIG. 2. For example, the barrier rib 212 includes a first barrier rib 212*b* and a second barrier rib 212*a*. The barrier rib 212 may have a differential type barrier rib structure in which heights of the first and second barrier ribs 212*b* and 212*a* are different from each other, a channel type barrier rib structure in which a channel usable as an exhaust path is formed on at least one of the first barrier rib 212*b* or the second barrier rib 212*a*, a hollow type barrier rib structure in which a hollow is formed on at least one of the first barrier rib 212*b* or the second barrier rib 212*a*, and the like.

In the differential type barrier rib structure, a height of the first barrier rib 212*b* may be smaller than a height of the second barrier rib 212*a*. In the channel type barrier rib structure, a channel may be formed on the first barrier rib 212*b*.

Each of the discharge cells partitioned by the barrier ribs 212 may be filled with a discharge gas.

A phosphor layer 214 may be positioned inside the discharge cells to emit visible light for an image display during an address discharge. For example, red, green, and blue phosphor layers may be positioned.

A thickness of at least one of the red, green, and blue phosphor layers 214 may be different from thicknesses of the other phosphor layers.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be larger than a width or thickness of the address electrode 213 outside the discharge cell.

When a predetermined signal is supplied to at least one of the scan electrode 202, the sustain electrode 203, and the address electrode 213, a discharge occurs inside the discharge cell. Hence, ultraviolet rays are generated by the discharge gas filled in the discharge cell because of the discharge, and are emitted on phosphor particles of the phosphor layer 214. Then, the phosphor particles emit visible light to thereby display an image on the screen of the plasma display panel.

Figure 3:
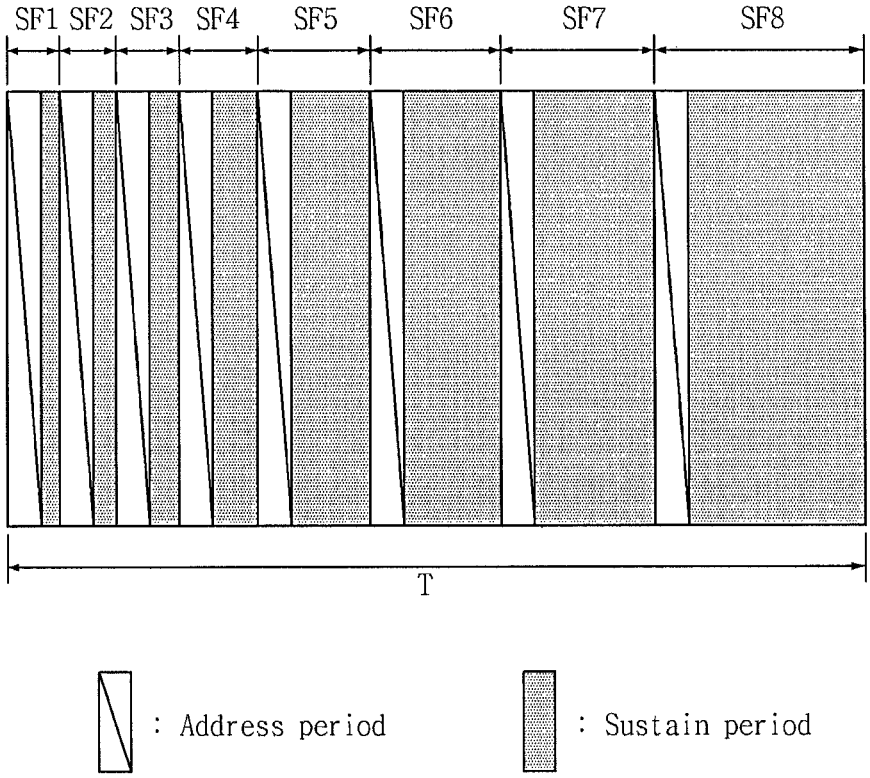
FIG. 3 illustrates a frame for achieving a gray scale of an image in the plasma display apparatus.

FIG. 3 illustrates a frame for achieving a gray scale of an image in the plasma display apparatus.

As shown in FIG. 3, a frame may include a plurality of subfields. Each subfield may be divided into an address period and a sustain period. During the address period, the discharge cells not to generate a discharge are selected or the discharge cells to generate a discharge are selected. During the sustain period, gray levels are achieved depending on the number of discharges.

For example, as shown in FIG. 3, if an image with 256-level gray scale is to be displayed, a frame may be divided into 8 subfields SF1 to SF8. Each of the 8 subfields SF1 to SF8 may be subdivided into an address period and a sustain period.

The number of sustain signals supplied during the sustain period determines gray level weight in each of the subfields. For example, in such a method of setting gray level weight of a first subfield to $2^0$ and gray level weight of a second subfield to $2^1$, the sustain period increases in a ratio of $2^n$ (where, n=0, 1, 2, 3, 4, 5, 6, 7) in each of the subfields. Hence, various gray levels of an image can be achieved by controlling the number of sustain signals supplied during the sustain period of each subfield depending on the gray level weight of each subfield.

In FIG. 3, while one frame includes 8 subfields, the number of subfields constituting one frame may vary. For example, one frame may include 12 subfields or 10 subfields. Further, in FIG. 3, while the subfields of one frame are arranged in increasing order of gray level weight, the subfields may be arranged in decreasing order of gray level weight, or may be arranged regardless of gray level weight.

At least one of the plurality of subfields of one frame may be a selective write subfield SW, and at least one of the other subfields may be a selective erase subfield SE.

If a frame includes at least one selective write subfield and at least one selective erase subfield, it may be preferable that a first subfield of a plurality of subfields of the frame is a selective write subfield and the other subfields are selective erase subfields. Or, all the subfields of the frame may be selective erase subfields.

The selective erase subfield is a subfield in which the discharge cell where a data signal is supplied to the address electrode during an address period is turned off during a sustain period following the address period. The selective write subfield is a subfield in which the discharge cell where a data signal is supplied to the address electrode during an address period is turned on during a sustain period following the address period.

A method of driving the plasma display apparatus is described below with reference to FIGS. 4A to 10.

Figure 4A:
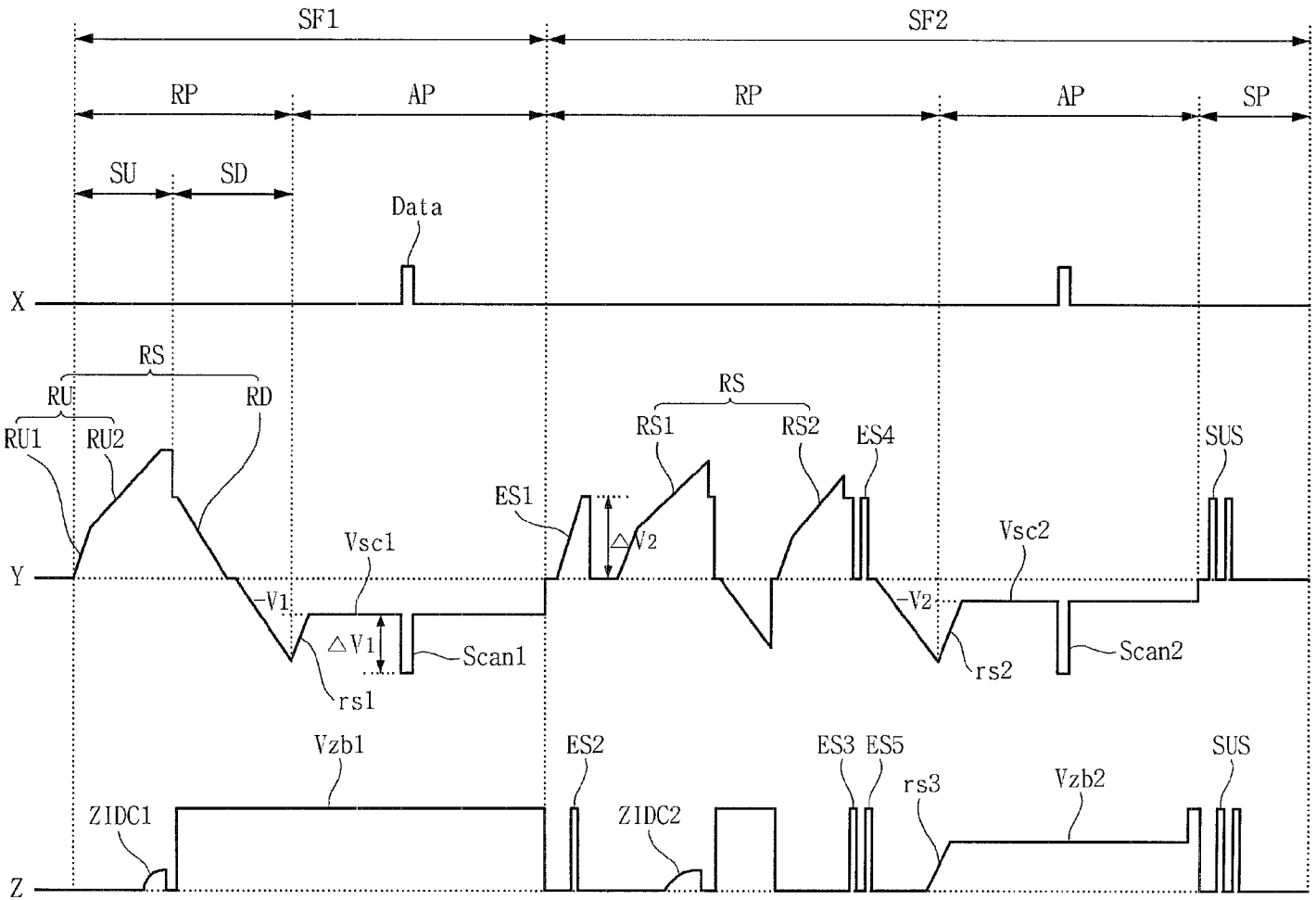
FIGS. 4A and 4B illustrate an exemplary method of driving the plasma display apparatus.
Figure 4B:
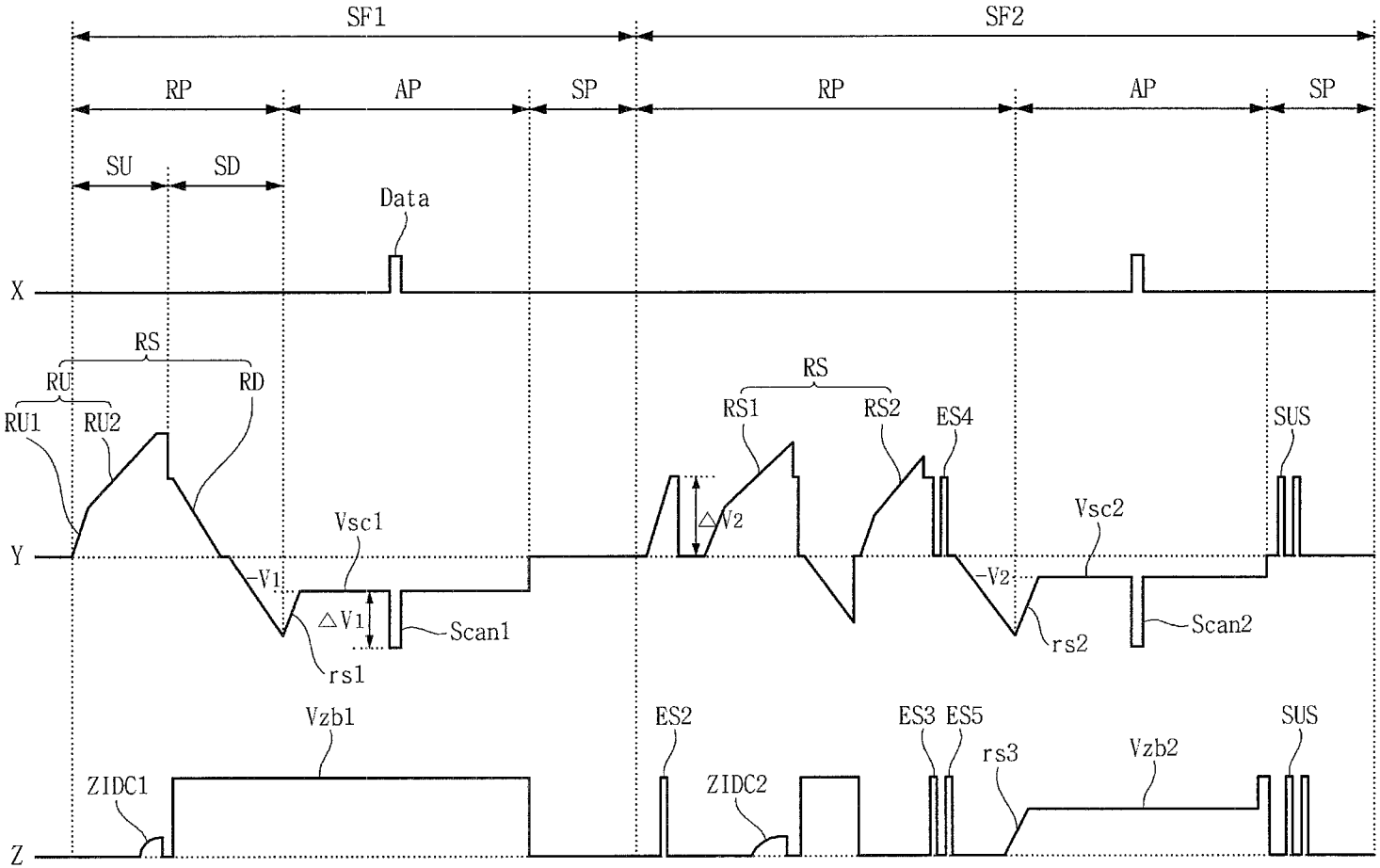

In FIGS. 4A and 4B, a first subfield SF1 and a second subfield SF2 may be two subfields which are earliest arranged in a plurality of subfields of a frame in time order. Or, another subfield may be arranged before the first subfield SF1.

As shown in FIG. 4A, during a reset period RP for initialization of the first subfield SF1, a reset signal RS may be supplied to the scan electrode Y. The reset signal RS includes a rising signal RU and a falling signal RD.

More specifically, during a setup period SU of the reset period RP, the rising signal RU is supplied to the scan electrode Y to thereby generate a weak dark discharge (i.e., a setup discharge) inside the discharge cell. Hence, a proper amount of wall charges may be accumulated inside the discharge cell. The rising signal RU may include a first rising signal RU1 and a second rising signal RU2. A slope of the first rising signal RU1 may be larger than a slope of the second rising signal RU2. As a result, a voltage of the scan electrode Y rapidly increases before the setup discharge occurs, and the voltage of the scan electrode Y relatively slowly increases while the setup discharge occurs. Hence, an excessive increase in a length of the setup period SU can be prevented, and the setup discharge can occur more stably.

During a set-down period SD of the reset period RP, the falling signal RD is supplied to the scan electrode Y to thereby generate a weak erase discharge (i.e., a set-down discharge) inside the discharge cell. Hence, the remaining wall charges are uniform inside the discharge cells to the extent that an address discharge occurs stably.

While the reset signal RS is supplied to the scan electrode Y during the reset period RP, a first projection signal ZIDC1 may be supplied to the sustain electrode Z so that an excessive strong discharge does not occur between the scan electrode Y and the sustain electrode Z.

During an address period AP following the reset period RP, a first scan bias signal Vsc1, whose a voltage level is substantially hold at a voltage V1 larger than a lowest voltage of the falling signal RD, may be supplied to the scan electrode Y. A first rising signal rs1 between the falling signal RD and the first scan bias signal Vsc1 may be supplied to the scan electrode Y. The supplying of the first rising signal rs1 reduces a coupling effect between the neighboring electrodes to thereby reduce a noise. A first scan signal Scan1 falling from the first scan bias signal Vsc1 may be supplied to the scan electrode Y.

A width of a scan signal supplied to the scan electrode during an address period of at least one subfield may be different from widths of scan signals supplied during address periods of the other subfields. A width of a scan signal in a subfield may be larger than a width of a scan signal in a next subfield in time order. For example, a width of the scan signal may be gradually reduced in the order of 2.6 μs, 2.3 μs, 2.1 μs, 1.9 μs, etc., or may be reduced in the order of 2.6 μs, 2.3 μs, 2.3 μs, 2.1 μs, . . . , 1.9 μs, 1.9 μs, etc, in the successively arranged subfields.

When the first scan signal Scan1 is supplied to the scan electrode Y, a data signal Data corresponding to the first scan signal Scan1 may be supplied to the address electrode X. As the voltage difference between the first scan signal Scan1 and the data signal Data is added to the wall voltage produced during the reset period RP, an address discharge occurs inside the discharge cell to which the data signal Data is supplied.

During the address period AP, a first sustain bias signal Vzb1 may be supplied to the sustain electrode Z so as to prevent the address discharge from unstably occurring by interference of the sustain electrode Z. A voltage level of the first sustain bias signal Vzb1 may be substantially equal to a voltage level of a sustain signals SUS, that is supplied to at least one of the scan electrode or the sustain electrode during a sustain period of the second subfield SF2 following the first subfield SF1.

As shown in FIG. 4A, a reset period RP of the second subfield SF2 immediately follows the address period AP of the first subfield SF1. Or, as shown in FIG. 4B, a sustain period SP of the first subfield SF1 immediately follows the address period AP of the first subfield SF1, but the sustain signal may not be supplied during the sustain period SP.

Hereinafter, a reason why the sustain signal is not supplied during the sustain period or the sustain signal is omitted from a frame will be described in detail with reference to FIGS. 5A to 5C.

Figure 5A:
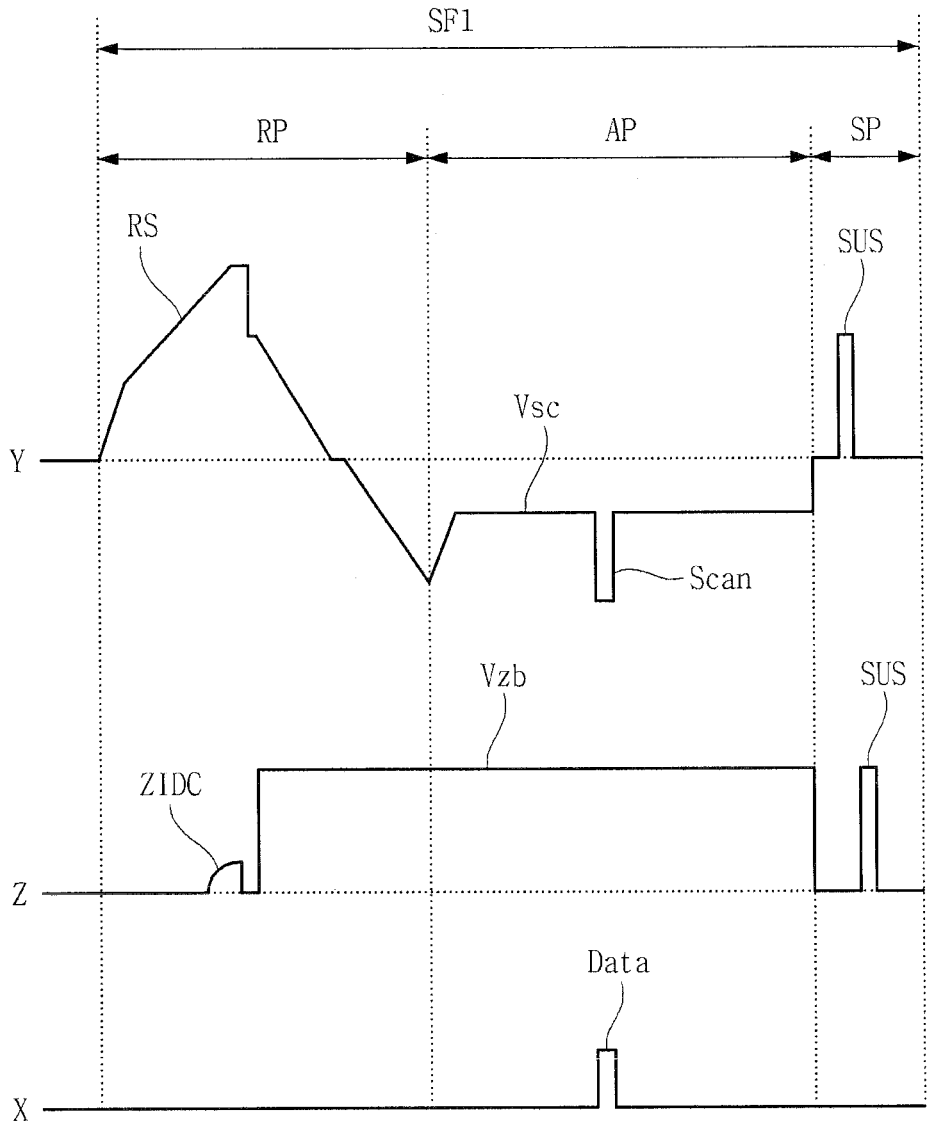
FIGS. 5A to 5C illustrate a reason why a sustain signal is not supplied.

As shown in FIG. 5A, one sustain signal SUS is respectively supplied to the scan electrode Y and the sustain electrode Z during a sustain period SP of a first subfield SF1. In this case, the amount of light generated during a reset period RP, an address period AP, and the sustain period SP is added together to achieve a gray level.

It is assumed that a gray level of light generated by one sustain signal SUS is 0.5 and a gray level of light generated by a data signal Data and a scan signal Scan is 0.5. Light generated during a reset period is negligible. The assumptions are voluntarily set for the convenience of explanation.

Figure 5B:
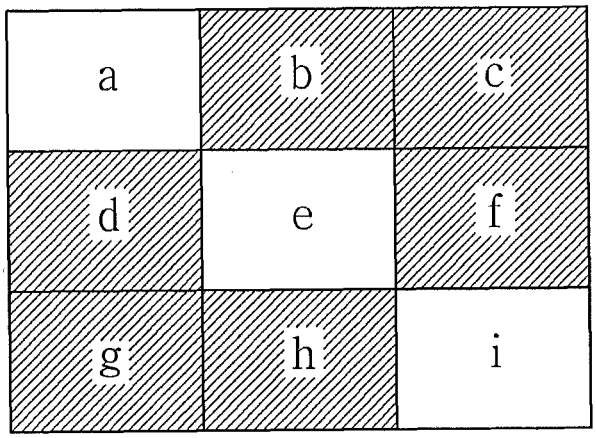

As shown in FIG. 5B, if an image with 0.5 gray level is to be displayed in an area comprised of 3×3 discharge cells a to i, the three discharge cells a, e, and i have to be turned on. Hence, a gray level of light generated in the area comprised of the 9 discharge cells a to i is 4.5 (=1.5×3). It may be perceived that a gray level of the image achieved by each of the 9 discharge cells is 0.5. In a method illustrated in FIG. 5B, a given pattern may be displayed on the screen, and the image quality may worsen.

If the sustain period is omitted or the sustain signal is not supplied during the sustain period as in FIGS. 4A and 4B, a representable gray level in the first subfield is 0.5.

Figure 5C:
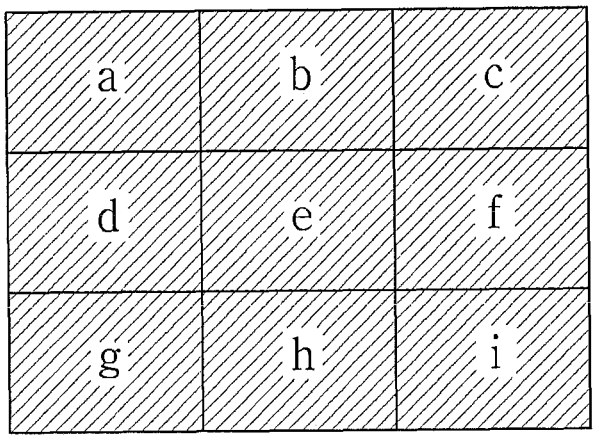

As shown in FIG. 5C, if an image with 0.5 gray level is to be displayed in an area comprised of 3×3 discharge cells a to i, all the 9 discharge cells a to i have to be turned on. Hence, in a method illustrated in FIG. 5B, a given pattern is not displayed on the screen, and the image quality can be improved.

Figure 6:
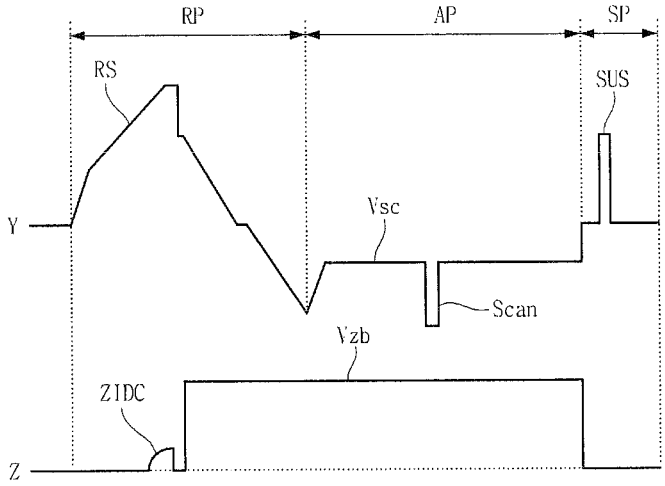
FIG. 6 illustrates an exemplary method in which a sustain signal is not supplied.
Figure 6:
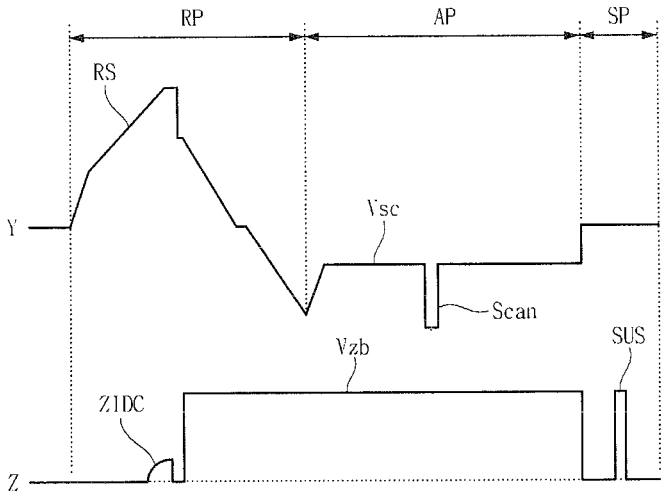

As shown in (a) of FIG. 6, during a sustain period SP of a first subfield, one sustain signal SUS is supplied to the scan electrode Y, and a sustain signal is not supplied to the sustain electrode Z. Or, as shown in (b) of FIG. 6, during a sustain period SP of a first subfield, one sustain signal SUS is supplied to the sustain electrode Z, and a sustain signal is not supplied to the scan electrode Y. As above, the image quality in a case where the sustain signal is supplied to one of the scan and sustain electrodes during the sustain period can be more excellent than the image quality in a case where sustain signals are supplied to both of the scan and sustain electrodes during a sustain period.

Referring again to FIGS. 4A and 4B, a first signal ES1 is supplied to the scan electrode Y during the reset period RP of the second subfield SF2 following the first subfield SF1. The first signal ES1 may be a positive polarity signal with a gradually rising voltage. The first signal ES1 generates an erase discharge between the scan electrode Y and the sustain electrode Z to thereby reduce the amount of wall charges inside the discharge cell. The first signal ES1 may be supplied in the first subfield SF1. However, it may be preferable that the first signal ES1 is supplied in the second subfield SF2 so as to stably generate a reset discharge in the second subfield SF2 following the first subfield SF1.

The first signal ES1 is described in detail below.

Because the sustain period is omitted from the first subfield or the sustain signal is not supplied in the first subfield, a distributed state of the wall charges may be very unstable at an end of the first subfield.

It is assumed that an address discharge occurs in a first discharge cell and an address discharge does not occur in a second discharge cell in the first subfield. In this case, a sufficient amount of wall charges are accumulated inside the first discharge cell to the extent that a sustain discharge can occur when a sustain signal is supplied. Further, a small amount of wall charges remains inside the second discharge cell to the extent that a sustain discharge does not occur even if a sustain signal is supplied.

If a sustain discharge occurs by the supplying of a sustain signal in the first subfield, a reset operation can be smoothly performed during the reset period of the second subfield following the first subfield because there is a change in a state of wall charges distributed in the first discharge cell. However, because the sustain signal is not supplied in the first subfield, a state of wall charges distributed during the address period of the first subfield may be maintained till the reset period of the second subfield. Hence, a reset discharge may be unstably generated in the second subfield.

On the other hand, if the first signal is supplied to the scan electrode before the reset signal is supplied during the reset period of the second subfield, the wall charges distributed in the first discharge cell may be erased. Hence, a difference between the amount of wall charges in the first discharge cell and the amount of wall charges in the second discharge cell can be reduced, and the reset discharge can be stably generated in the second subfield.

It may be preferable that a rising slope of the first signal ES1 is larger than a rising slope of the reset signal supplied to the scan electrode during the reset period so as to smoothly erase the wall charges. For example, supposing that first and second reset signals are supplied to the scan electrode in the first subfield, the rising slope of the first signal ES1 is larger than rising slopes of the first and second reset signals. If the rising slope of the first signal ES1 is smaller than the rising slope of the reset signal, the wall charges are not erased and may increase.

As shown in FIG. 4B, a second signal ES2 corresponding to the first signal ES1 may be supplied to the sustain electrode Z. The first and second signals ES1 and ES2 are described below with reference to FIGS. 7A and 7B.

Figure 7A:
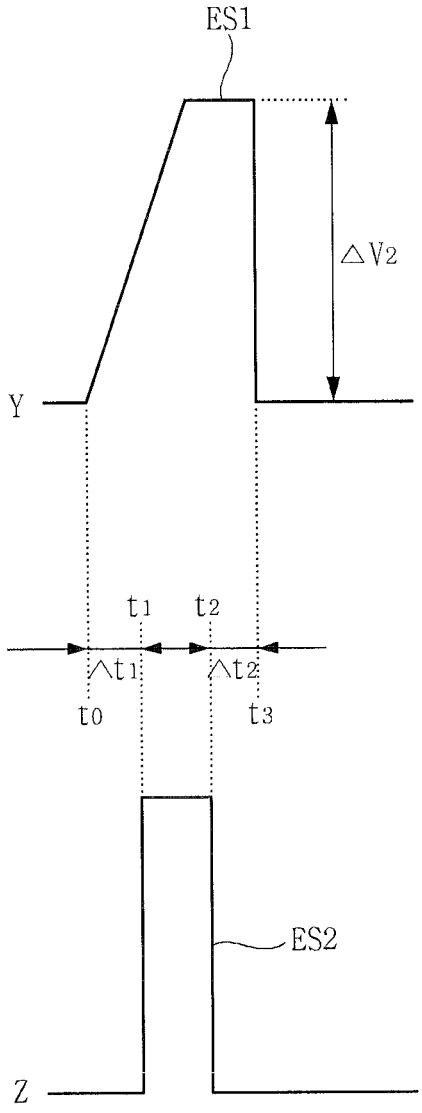
FIGS. 7A and 7B illustrate a first signal and a second signal.

As shown in FIG. 7A, a supply start time point t0 of the first signal ES1 is earlier taken a supply start time point t1 of the second signal ES2 by a time interval of $^{\Delta}$t1, and a supply end time point t3 of the first signal ES1 is later than a supply end time point t2 of the second signal ES2 by a time interval of $^{\Delta}$t2. The first signal ES1 partially overlaps the second signal ES2, and a pulse width of the second signal ES2 is smaller than a pulse width of the first signal ES1.

When an address discharge occurs between the scan electrode and the address electrode during the address period of the first subfield SF1, the wall charges are accumulated on the scan electrode and the address electrode. The first signal ES1 is supplied to the scan electrode in the second subfield so as to erase the wall charges after the address period of the first subfield SF1. Hence, it may be advantageous to generate an erase discharge using the wall charges on the scan electrode.

If the pulse width of the second signal ES2 widens, wall charges may be accumulated on the sustain electrode after the erase discharge. Therefore, it may be advantageous that the pulse width of the second signal ES2 is smaller than the pulse width of the first signal ES1 so as to prevent the wall charges from being accumulated on the sustain electrode.

Figure 7B:
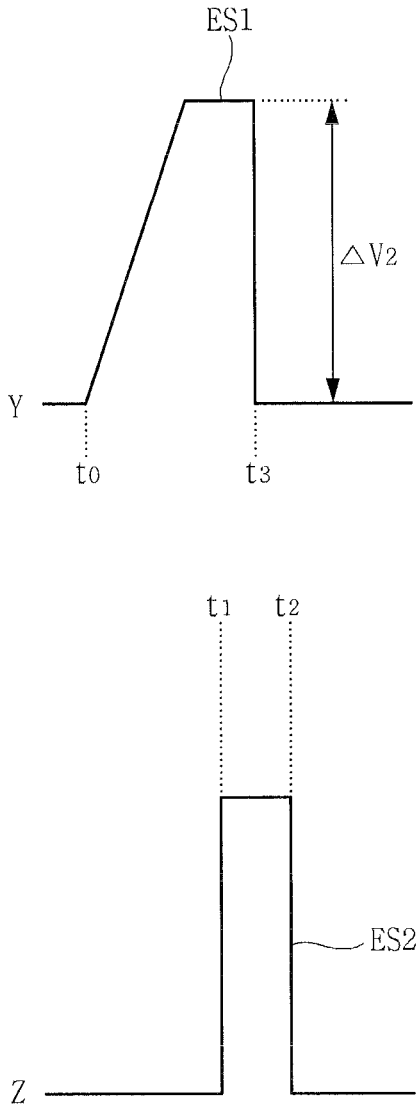

As shown in FIG. 7B, a pulse width of the second signal ES2 is smaller than a pulse width of the first signal ES1. A supply start time point t0 of the first signal ES1 is earlier than a supply start time point t1 of the second signal ES2, and a supply end time point t3 of the first signal ES1 is earlier than a supply end time point t2 of the second signal ES2. It may be more advantageous in the erase discharge that a polarity of the first signal ES1 is substantially the same as a polarity of the second signal ES2.

Because the address discharge is generated by the scan signal supplied to the scan electrode, a voltage magnitude of the first signal ES1 may be equal to or larger than a voltage magnitude of the scan signal so as to sufficiently erase the wall charges formed by the address discharge during the address period of the first subfield.

A voltage magnitude $^{\Delta}$V2 of the first signal ES1 and a voltage magnitude $^{\Delta}$V1 of the scan signal are described with reference to Table 1.

TABLE 1

| $\Delta V_2/\Delta V_1$ | A<br>Bright defect | B<br>Intensity of<br>Address discharge |
|---|---|---|
| 0.8 | X | ◎ |
| 0.9 | X | ◎ |
| 1.0 | ○ | ◎ |
| 1.1 | ◎ | ◎ |
| 1.5 | ◎ | ◎ |
| 1.7 | ◎ | ◎ |
| 1.8 | ◎ | ○ |
| 2.2 | ○ | X |
| 2.5 | X | X |

In Table 1, a case A indicates data of bright defect obtained when a ratio $^{\Delta}$V2/$^{\Delta}$V1 changes from 0.8 to 2.5 by changing the voltage magnitude $^{\Delta}$V2 of the first signal ES1 in a state where the voltage magnitude $^{\Delta}$V1 of the scan signal is fixed at about 120 V. Many observers sensorially observed the generation of bright defect in an image of a predetermined pattern on the screen in a darkroom. A case B indicates data for an intensity of address discharge obtained when a ratio $^{\Delta}$V2/$^{\Delta}$V1 changes from 0.8 to 2.5 by changing the voltage magnitude $^{\Delta}$V1 of the scan signal in a state where the voltage magnitude $^{\Delta}$V2 of the first signal ES1 is fixed at about 180 V. In Table 1, X indicates the reading of "bad" when the bright defect excessively occurs or the intensity of address discharge is excessively weak; ○ indicates the reading of "good"; and ◎ indicates the reading of "excellent" when the generation of bright defect is prevented or the intensity of address discharge is sufficiently strong.

In the case A, when the ratio $^{\Delta}$V2/$^{\Delta}$V1 is 0.8 to 0.9, because the voltage magnitude $^{\Delta}$V2 of the first signal ES1 is excessively smaller than the voltage magnitude $^{\Delta}$V1 of the scan signal, an intensity of the erase discharge generated by the first signal ES1 is excessively weak or even the erase discharge may not occur. Hence, an excessively strong reset discharge occurs in the discharge cell where the address discharge occurs, and the bright defect may be excessively displayed on the screen.

When the ratio $^{\Delta}$V2/$^{\Delta}$V1 is 1.0, the bright defect may be slightly displayed.

When the ratio $^{\Delta}$V2/$^{\Delta}$V1 is equal to or larger then 1.1, the erase discharge may become sufficiently strong because the voltage magnitude $^{\Delta}$V2 of the first signal ES1 is sufficiently larger than the voltage magnitude $^{\Delta}$V1 of the scan signal. Hence, the wall charges are sufficiently erased, and the generation of bright defect is reduced.

In the case B, when the ratio $^{\Delta}$V2/$^{\Delta}$V1 is 0.8 to 1.7, the intensity of the address discharge may become sufficiently strong because the voltage magnitude $^{\Delta}$V1 of the scan signal is sufficiently smaller than the voltage magnitude $^{\Delta}$V2 of the first signal ES1.

When the ratio $^{\Delta}$V2/$^{\Delta}$V1 is 1.8, the intensity of the address discharge is proper.

When the ratio $^{\Delta}$V2/$^{\Delta}$V1 is 2.2 to 2.5, the intensity of the address discharge may be excessively weak because the voltage magnitude $^{\Delta}V1$ of the scan signal is excessively smaller than the voltage magnitude $^{\Delta}V2$ of the first signal ES1.

The ratio $^{\Delta}V2/^{\Delta}V1$ of the voltage magnitude $^{\Delta}V2$ of the first signal to the voltage magnitude $^{\Delta}V1$ of the scan signal may be substantially 1.0 to 1.8 or 1.1 to 1.7 in consideration of the data of Table 1.

Figure 8:
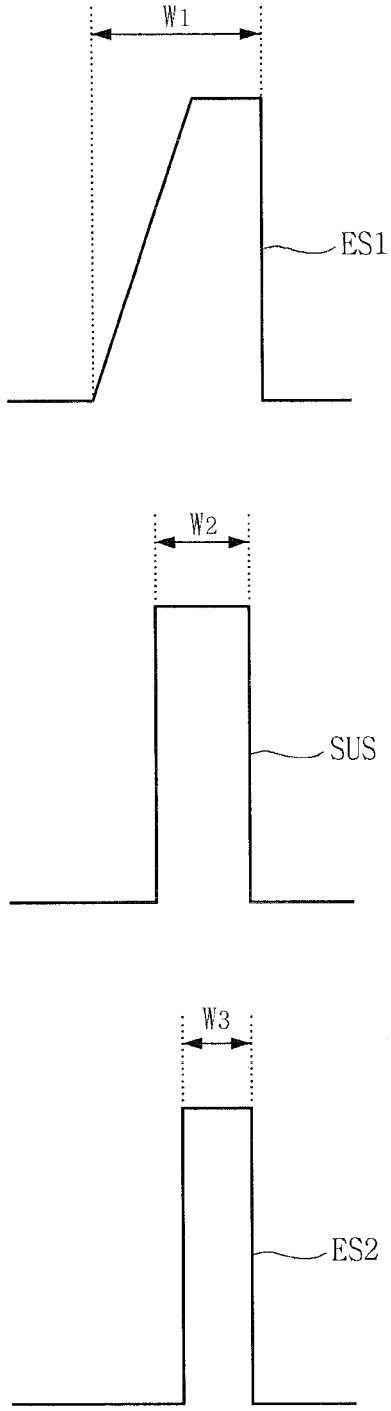
FIG. 8 illustrates a pulse width of the first signal and a pulse width of the second signal.

As shown in FIG. 8, a pulse width W1 of the first signal ES1 may be larger than a pulse width W2 of the sustain signals SUS supplied to at least one of the scan electrode or the sustain electrode during the sustain period. The pulse width W2 of the sustain signals SUS may be larger than a pulse width W3 of the second signal ES2. The pulse width W2 of the sustain signals SUS is a minimum pulse width of the sustain signals SUS.

If the pulse width W1 of the first signal ES1 is smaller than the pulse width W2 of the sustain signals SUS, the wall charges accumulated on the scan electrode cannot be satisfactory erased. Further, if the pulse width W2 of the sustain signals SUS is smaller than the pulse width W3 of the second signal ES2, the wall charges may be excessively accumulated on the sustain electrode after the erase discharge. Accordingly, it may be preferable that the pulse width W1 of the first signal ES1 is larger than the pulse width W2 of the sustain signals SUS, and the pulse width W2 of the sustain signals SUS is larger than the pulse width W3 of the second signal ES2.

A relationship between the pulse width W1 of the first signal ES1 and the pulse width W2 of the sustain signals SUS is described below with reference to Table 2.

Table 2 indicates data for bright defect and a drive time when a ratio W1/W2 of the pulse width W1 of the first signal ES1 to the pulse width W2 of the sustain signals SUS changes from 0.8 to 4.1. Many observers sensorially observed the generation of bright defect in an image of a predetermined pattern on the screen in a darkroom.

TABLE 2

| $W_1/W_2$ | Bright defect | Drive time |
|---|---|---|
| 0.8 | X | ◎ |
| 0.9 | X | ◎ |
| 1.0 | ○ | ◎ |
| 1.2 | ○ | ◎ |
| 1.5 | ◎ | ◎ |
| 2.0 | ◎ | ◎ |
| 2.6 | ◎ | ◎ |
| 2.9 | ◎ | ◎ |
| 3.3 | ◎ | ○ |
| 3.7 | ○ | ○ |
| 4.1 | ○ | X |

In Table 2, X indicates the reading of "bad" when the bright defect excessively occurs or the drive time is insufficient; ○ indicates the reading of "good"; and ◎ indicates the reading of "excellent" when the generation of bright defect is prevented or the drive time is sufficient.

In terms of the bright defect, when the ratio W1/W2 is 0.8 to 0.9, the wall charges inside the discharge cells cannot be sufficiently erased by the first signal ES1 because the pulse width W1 of the first signal ES1 is excessively smaller than the pulse width W2 of the sustain signals SUS. Hence, the bright defect may be excessively displayed on the screen.

When the ratio W1/W2 is 1.0 to 1.2, the bright defect may be slightly displayed.

When the ratio W1/W2 is 1.5 to 3.3, the wall charges inside the discharge cells can be sufficiently erased by the first signal ES1 because the pulse width W1 of the first signal ES1 is sufficiently larger than the pulse width W2 of the sustain signals SUS. Hence, the generation of bright defect is prevented.

When the ratio W1/W2 is equal to or larger than 3.7, the bright defect may be slightly displayed.

In terms of the drive time, when the ratio W1/W2 is 0.8 to 2.9, an excessive increase in the drive time by the first signal ES1 is prevented because the pulse width W1 of the first signal ES1 is sufficiently larger than the pulse width W2 of the sustain signals SUS.

When the ratio W1/W2 is 3.3 to 3.7, the drive time is slightly insufficient because the pulse width W1 of the first signal ES1 is larger than the pulse width W2 of the sustain signals SUS.

When the ratio W1/W2 is equal to or larger than 4.1, the drive time is insufficient because the pulse width W1 of the first signal ES1 is excessively larger than the pulse width W2 of the sustain signals SUS.

It may be preferable that the ratio W1/W2 of the pulse width W1 of the first signal ES1 to the pulse width W2 of the sustain signals SUS is 1.0 to 3.7 or 1.5 to 2.9.

Figure 9:
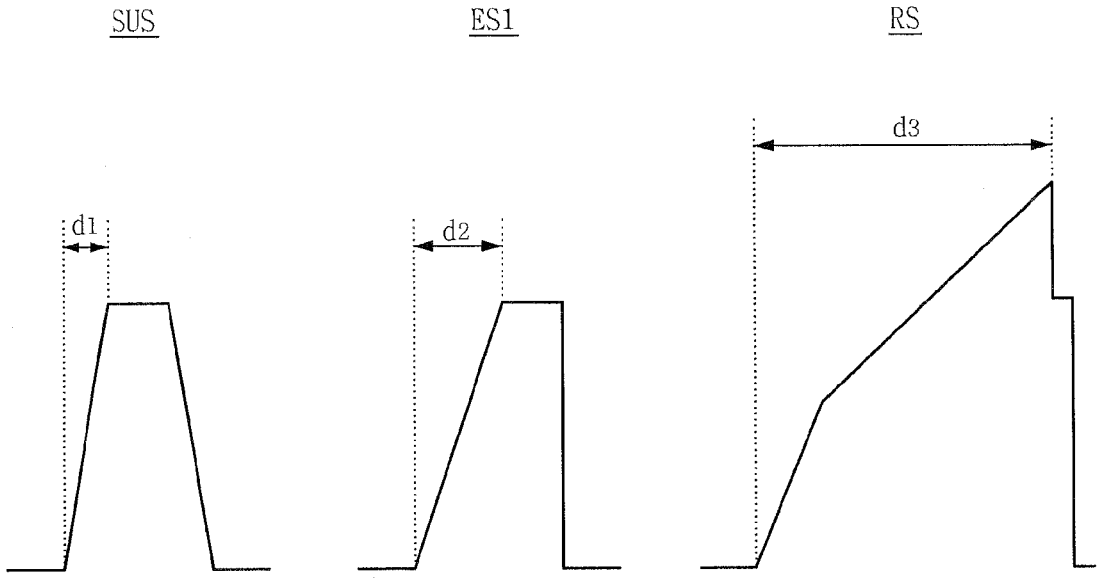
FIG. 9 illustrates a rising slope of the first signal.

As shown in FIG. 9, a rising slope of the first signal ES1 during a period d2 may be smaller than a rising slope of the sustain signals SUS during a period d1. The rising slope of the first signal ES1 during the period d2 may be larger than a rising slope of the reset signal RS during a period d3. In this case, the erase discharge can be efficiently generated by the first signal ES1.

Referring again to FIGS. 4A and 4B, a plurality of reset signals may be supplied during the reset period RP of the second subfield SF2 when the first signal ES1 is supplied. More specifically, a first reset signal RS1 and a second reset signal RS2 may be supplied to the scan electrode Y so as to uniformly distribute the wall charges inside the discharge cells in the second subfield SF2 following the first subfield SF1 in which the sustain signal is not supplied. Hence, a reset discharge can stably occur during the reset period of the second subfield SF2.

During the reset period RP of the second subfield SF2, a second projection signal ZIDC2 may be supplied to the sustain electrode during the supplying of the first reset signal RS1 so as to prevent an excessively strong discharge from occurring between the scan electrode Y and the sustain electrode Z.

The second reset signal RS2 may include third, fourth, and fifth signals ES3, ES4, and ES5 so as to uniformly distribute the wall charges inside the discharge cells.

A second rising signal rs2 may be supplied between the second reset signal RS2 and a second scan bias signal Vsc2. The supplying of the second rising signal rs2 reduces a coupling effect between the neighboring electrodes to thereby reduce a noise.

A third rising signal rs3 corresponding to the second rising signal rs2 may be supplied to the sustain electrode. Hence, the noise can be further reduced.

During a sustain period SP of the second subfield SF2, the sustain signal SUS may be supplied to at least one of the scan electrode Y or the sustain electrode Z. For example, the sustain signals SUS is alternately supplied to the scan electrode Y and the sustain electrode Z.

As the wall voltage inside the discharge cell selected by performing the address discharge is added to a sustain voltage Vs of the sustain signal SUS, every time the sustain signal SUS is supplied, a sustain discharge, i.e., a display discharge occurs between the scan electrode Y and the sustain electrode Z.

A plurality of sustain signals are supplied during a sustain period of at least one subfield, and a width of at least one of the plurality of sustain signals may be different from widths of the other sustain signals. For example, a width of a first supplied sustain signal among the plurality of sustain signals may be larger than widths of the other sustain signals. Hence, a sustain discharge can more stably occur.

Figure 10:
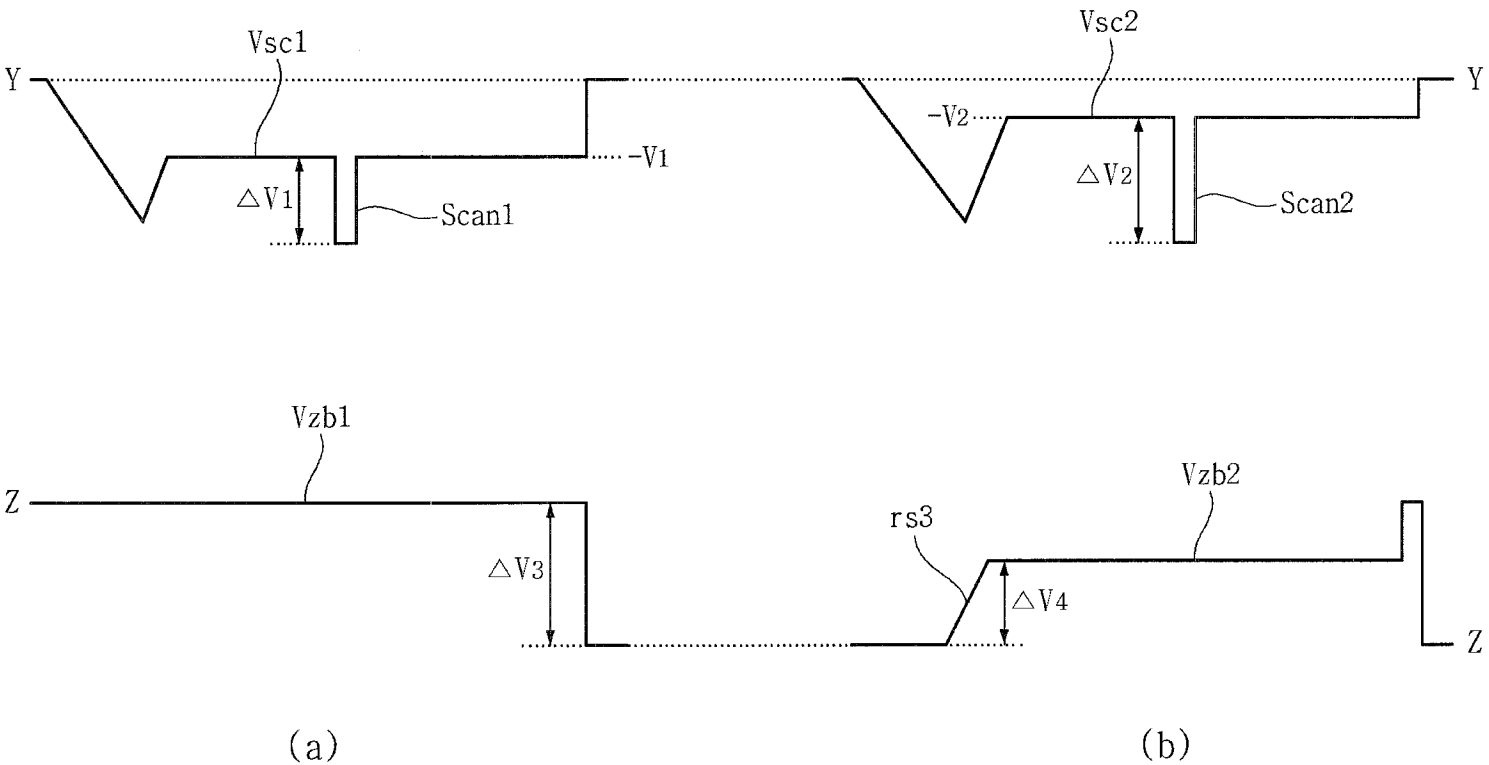
FIG. 10 illustrates a voltage difference between a scan electrode and a sustain electrode during an address period.

A voltage difference between the scan electrode and the sustain electrode during the address period is described below with reference to FIG. 10. More specifically, a voltage difference between the scan electrode and the sustain electrode during the address period of the first subfield as shown in (a) of FIG. 10 may be larger than a voltage difference between the scan electrode and the sustain electrode during the address period of the second subfield as shown in (b) of FIG. 10. Hence, the address discharge can more stably occur in the first subfield in which the sustain signal is not supplied, and a gray level of the first subfield can be clearly set.

Supposing that a gray level of light generated by the address discharge in the first subfield is 0.2, a representable gray level of the first subfield is about 0.2 because the sustain signal is not supplied in the first subfield. In this case, a viewer cannot perceive a gray level difference of 0.2 because the representable gray level of the first subfield is very small. The image quality may worsen, and thus a gray level representation may worsen.

On the other hand, if the voltage difference between the scan electrode and the sustain electrode increases during the address period of the first subfield, the amount of light generated by the address discharge can increase. Hence, the gray level representation can be improved to the extent the viewer can perceive the gray level difference.

As above, a voltage magnitude $^{\Delta}V3$ of the first sustain bias signal Vzb1 in the first subfield may be larger than a voltage magnitude $^{\Delta}V4$ of the second sustain bias signal Vzb2 in the second subfield, so that the voltage difference between the scan electrode and the sustain electrode during the address period of the first subfield is larger than the voltage difference between the scan electrode and the sustain electrode during the address period of the second subfield or a voltage −V1 of the first scan bias signal Vsc1 in the first subfield may be lower than a voltage −V2 of the second scan bias signal Vsc2 in the second subfield. Or, a voltage magnitude $^{\Delta}V1$ of the first scan signal Scan1 in the first subfield may be smaller than a voltage magnitude $^{\Delta}V2$ of the second scan signal Scan2 in the second subfield.

Figure 11:
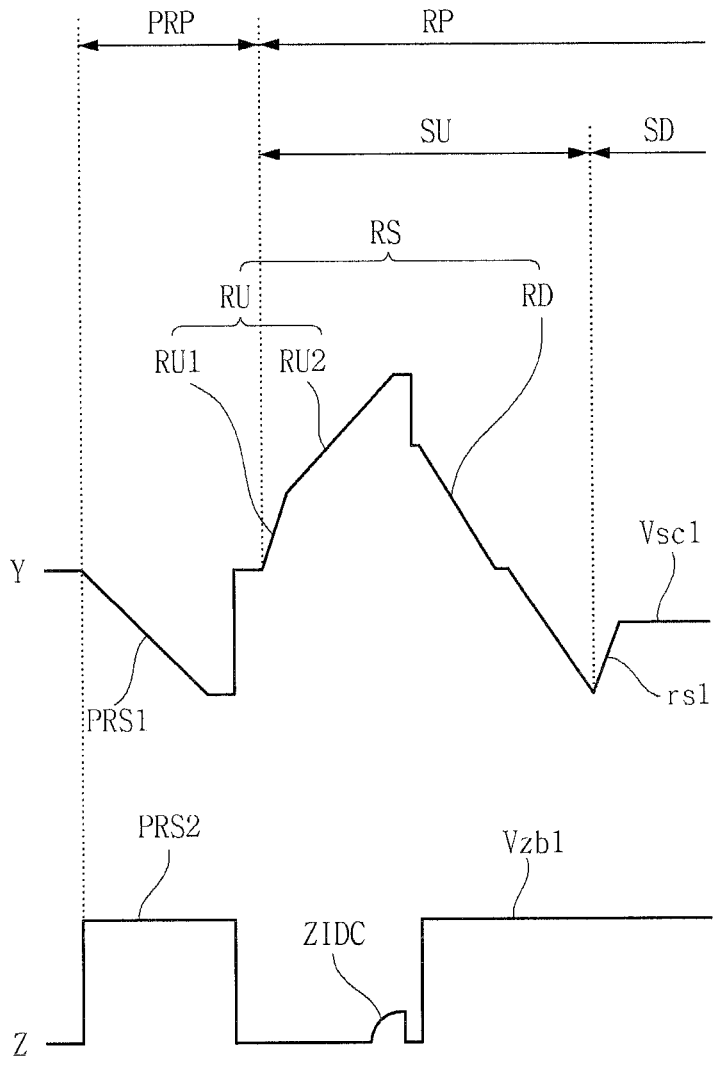
FIG. 11 illustrates a pre-reset period.

FIG. 11 illustrates a pre-reset period.

As shown in FIG. 11, the first subfield may include a pre-reset period PRP prior to the reset period RP of the first subfield. During the pre-reset period PRP, a first pre-reset signal PRS1, whose a polarity is opposite to a polarity of the reset signal RS, may be supplied to the scan electrode Y. A second pre-reset signal PRS2, whose a polarity is opposite to the polarity of the first pre-reset signal PRS1, may be supplied to the sustain electrode Z during the supplying of the first pre-reset signal PRS1. A voltage magnitude of the second pre-reset signal PRS2 may be substantially equal to the sustain voltage Vs of the sustain signal SUS.

Wall charges of a predetermined polarity are accumulated on the scan electrode, and wall charges with a polarity opposite the polarity of the wall charges on the scan electrode are accumulated on the sustain electrode by supplying the first and second pre-reset signals PRS1 and PRS2 during the pre-reset period PRP. For example, wall charges of a positive polarity may be accumulated on the scan electrode, and wall charges of a negative polarity may be accumulated on the sustain electrode. Hence, a setup discharge having sufficient intensity can occur during the reset period RP following the pre-reset period PRP, and an initialization operation can be stably performed. Even if a voltage of the rising signal RU of the reset signal RS is lowered, the setup discharge having sufficient intensity can occur.

To secure the drive time, a first arranged subfield of a frame may include a pre-reset period prior to a reset period or 2 or 3 subfields of a frame may include a pre-reset period prior to a reset period.

Figure 12:
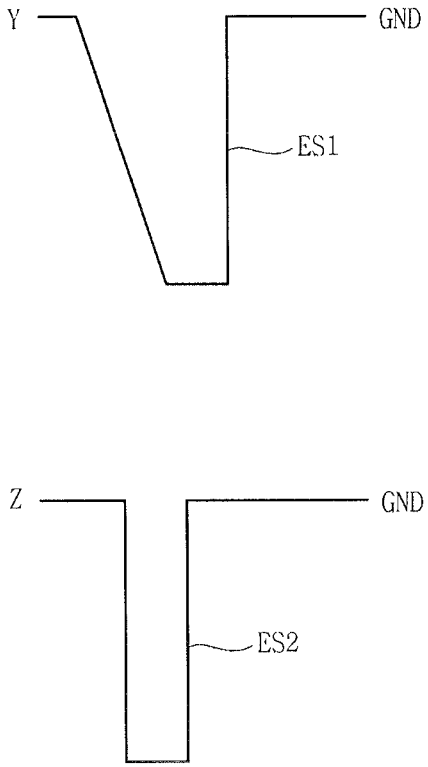
FIG. 12 illustrates a polarity of the first signal and a polarity of the second signal.

FIG. 12 illustrates a polarity of the first signal ES1 and a polarity of the second signal ES2.

As shown in FIG. 12, the first signal ES1 and the second signal ES2 may be negative polarity signals.

As above, in case that the first signal ES1 and the second signal ES2 are negative polarity signals, the first signal ES1 and the second signal ES2 may have the same polarity. Further, in case that the first signal ES1 and the second signal ES2 have the same polarity, the erase discharge can occur more effectively by the first signal ES1 and the second signal ES2.

Figure 13:
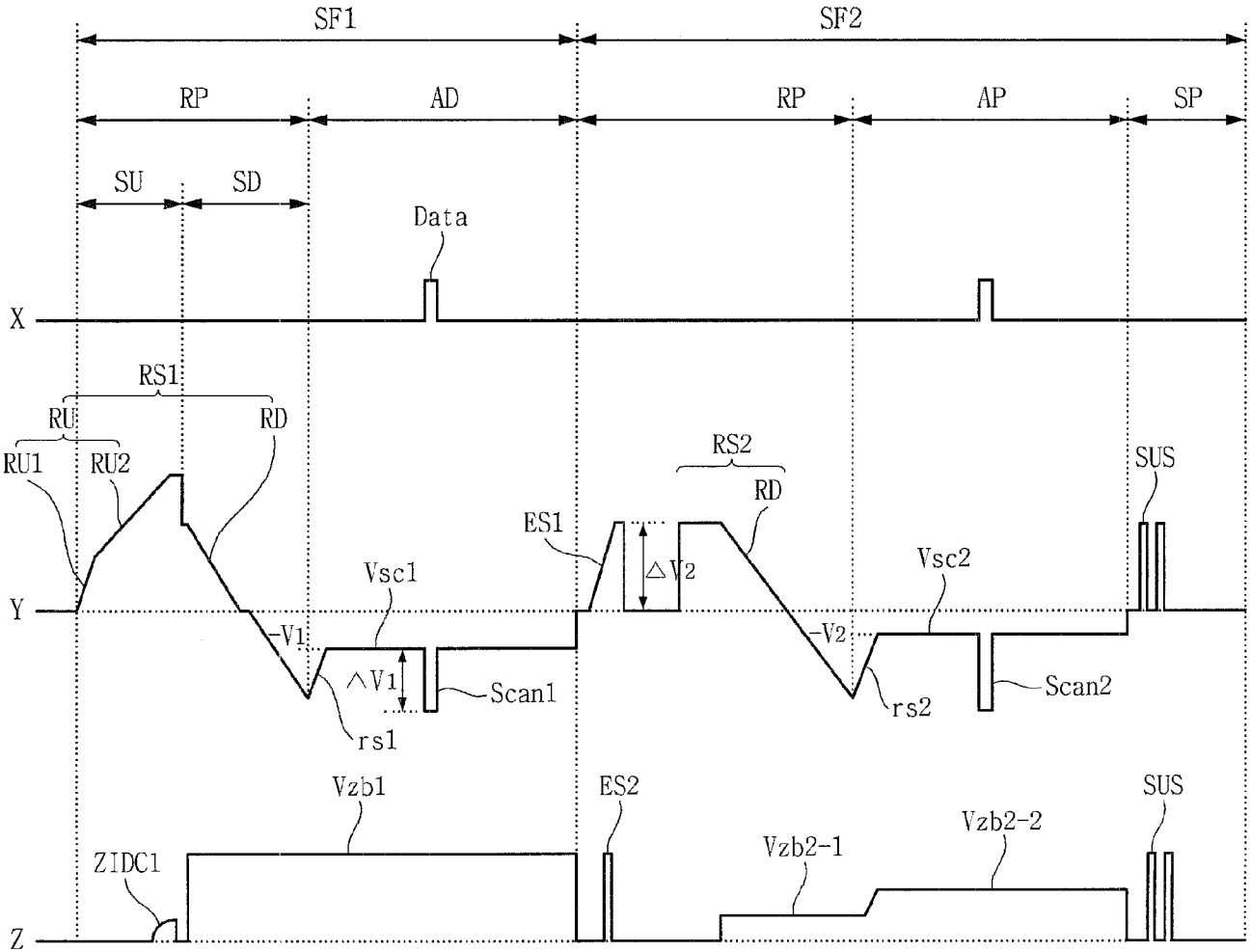
FIG. 13 illustrates a reset first signal and a reset second signal.

FIG. 13 illustrates a reset first signal and a reset second signal.

As shown in FIG. 13, a first reset signal RS1 may be supplied to the scan electrode Y during a reset period RP of a first subfield SF1 among a plurality of subfields of a frame. A second reset signal RS2, whose a maximum voltage is smaller than a maximum voltage of the first reset signal RS1, may be supplied to the scan electrode Y during a reset period RP of a second subfield SF2 immediately following the first subfield SF1. Hence, the amount of light generated during the reset period RP of the second subfield SF2 can be reduced, and thus contrast characteristics of an image can be improved.

The first reset signal RS1 may include a rising signal RU with a gradually rising voltage and a falling signal RD with a gradually falling voltage. The second reset signal RS2 may not include a rising signal with a gradually rising voltage and may include a falling signal RD with a gradually falling voltage.

A voltage magnitude of the first reset signal RS1 is larger than a voltage magnitude of the second reset signal RS2. The first subfield, in which the first reset signal RS1 is supplied, may be a first arranged subfield in the plurality of subfields of the frame in time order.

A voltage Vzb2-2 of the sustain electrode Z in an address period AP of the second subfield SF2 may be larger than a voltage Vzb2-1 of the sustain electrode Z in the reset period RP of the second subfield SF2. More specifically, during the reset period RP of the second subfield SF2, the voltage Vzb2-1 may be supplied to the sustain electrode during the supplying of the falling signal RD of the second reset signal RS2. During the address period AP of the second subfield SF2, the voltage Vzb2-2 larger than the voltage Vzb2-1 may be supplied to the sustain electrode. Hence, a reset discharge and an address discharge can stably occur in the second subfield SF2.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A method of driving a plasma display apparatus including a scan electrode and a sustain electrode that are positioned parallel to each other, the method comprising:

supplying a first reset signal to the scan electrode during a reset period of a first subfield among a plurality of subfields of a frame, the first reset signal including a rising signal with a gradually rising voltage and a falling signal with a gradually falling voltage;

supplying a scan signal to the scan electrode during an address period of the first subfield;

supplying a first projection signal to the sustain electrode, the first projection signal being overlapped with the rising signal of the first reset signal;

supplying a second reset signal to the scan electrode during a reset period of a second subfield immediately following the first subfield, the second reset signal including a first sub reset signal and a second sub reset signal supplied consecutively and each of the first sub reset signal and the second sub reset signal including a rising signal with a gradually rising voltage and a falling signal with a gradually falling voltage;

supplying a second projection signal to the sustain electrode, the second projection signal being overlapped with the rising signal of the first sub reset signal of the second reset signal;

supplying a first signal between the scan signal of the first subfield and the second reset signal to the scan electrode;

supplying a second signal during the second subfield overlapping the first signal to the sustain electrode, a pulse width of the second signal being smaller than a pulse width of the first signal:

supplying a first sustain bias signal to the sustain electrode during the address period of the first subfield; and supplying a bias voltage to the sustain electrode during the reset period of the second subfield, the bias voltage being overlapped with the falling signal of the first sub reset signal of the second reset signal, wherein a time-gap is disposed between the first sustain bias signal and the first projection signal, wherein a time-gap is disposed between the second projection signal and the bias voltage, wherein a peak voltage of either the first projection signal or the second projection signal is smaller than a peak voltage of the second signal, and wherein each of the first projection signal and the second projection signal includes a rising signal gradually rising from a ground voltage (GND) to the peak voltage and a falling signal from the peak voltage to the ground voltage (GND).

2. The method of claim 1, wherein the first signal and the second signal are supplied in the second subfield.

3. The method of claim 1, wherein, during a sustain period following the address period of the first subfield, a sustain signal is not supplied to at least one of the scan electrode or the sustain electrode or the sustain period is omitted from the first subfield.

4. The method of claim 1, wherein a supply start time point of the first signal is earlier than a supply start time point of the second signal, and a supply end time point of the first signal is later than a supply end time point of the second signal.

5. The method of claim 1, wherein the first signal and the second signal have the same polarity.

6. The method of claim 1, wherein the pulse width of the second signal is smaller than a pulse width of a sustain signal supplied to at least one of the scan electrode or the sustain electrode during a sustain period after the reset period of the second subfield.

7. The method of claim 1, wherein a rising slope of the first signal is larger than a rising slope of the second reset signal.

8. The method of claim 1, wherein the pulse width of the first signal is larger than a pulse width of a sustain signal supplied to at least one of the scan electrode or the sustain electrode during a sustain period after the reset period of the second subfield.

9. The method of claim 1, wherein a maximum voltage of the second reset signal is lower than a maximum voltage of the first reset signal.

10. The method of claim 1, wherein a second sustain bias signal is supplied to the sustain electrode during an address period of the second subfield, wherein a voltage of the first sustain bias signal is higher than a voltage of the second sustain bias signal.

11. The method of claim 1, wherein a first scan bias signal is supplied to the scan electrode during the address period of the first subfield, and a second scan bias signal is supplied to the scan electrode during an address period of the second subfield, wherein a voltage of the first scan bias signal is lower than a voltage of the second scan bias signal.

12. The method of claim 1, wherein a first scan signal is supplied to the scan electrode during the address period of the first subfield, and a second scan signal is supplied to the scan electrode during an address period of the second subfield, wherein a voltage magnitude of the first scan signal is smaller than a voltage magnitude of the second scan signal.

13. The method of claim 1, wherein a voltage magnitude of the first signal is equal to or larger than a voltage magnitude of a scan signal supplied to the scan electrode during an address period of at least one of the first subfield or the second subfield.

14. The method of claim 1, wherein a rising slope of the first signal is smaller than a rising slope of a sustain signal supplied to at least one of the scan electrode or the sustain electrode during a sustain period after the reset period of the second subfield.

15. The method of claim 1, wherein the first signal is a positive polarity signal.

16. The method of claim 1, wherein a supply start time point of the first signal is earlier than a supply start time point of the second signal, and a supply end time point of the first signal is earlier than a supply end time point of the second signal.

17. The method of claim 1, wherein the first subfield is a first arranged subfield in the plurality of subfields of the frame in time order.

18. A method of driving a plasma display apparatus including a scan electrode and a sustain electrode that are positioned parallel to each other, the method comprising:

supplying a first reset signal to the scan electrode during a reset period of a first subfield among a plurality of subfields of a frame, the first reset signal including a rising signal with a gradually rising voltage and a falling signal with a gradually falling voltage;

supplying a scan signal to the scan electrode during an address period of the first subfield;

supplying a first projection signal to the sustain electrode, the first projection signal being overlapped with the rising signal of the first reset signal;

supplying a second reset signal to the scan electrode during a reset period of a second subfield immediately following the first subfield, the second reset signal including a first sub reset signal and a second sub reset signal supplied consecutively and each of the first sub reset signal and the second sub reset signal including a rising signal with a gradually rising voltage and a falling signal with a gradually falling voltage;

supplying a second projection signal to the sustain electrode, the second projection signal being overlapped with the rising signal of the first sub reset signal of the second reset signal;

supplying a first signal between the scan signal of the first subfield and the second reset signal to the scan electrode;

supplying a second signal during the second subfield overlapping the first signal to the sustain electrode to generate an erase discharge between the scan electrode and the sustain electrode, a pulse width of the second signal being smaller than a pulse width of the first signal;

supplying a first sustain bias signal to the sustain electrode during the address period of the first subfield; and supplying a bias voltage to the sustain electrode during the reset period of the second subfield, the bias voltage being overlapped with the falling signal of the first sub reset signal of the second reset signal, wherein a time-gap is disposed between the first sustain bias signal and the first projection signal, wherein a time-gap is disposed between the second projection signal and the bias voltage, wherein a peak voltage of either the first projection signal or the second projection signal is smaller than a peak voltage of the second signal, wherein the first and second signals have a positive polarity, and wherein each of the first projection signal and the second projection signal includes a rising signal gradually rising from a ground voltage (GND) to the peak voltage and a falling signal from the peak voltage to the ground voltage (GND).

19. The method of claim 18, wherein the first signal has substantially the same magnitude of voltage as the second signal.

* * * * *